United States Patent [19]

Hauge

[11] Patent Number: 4,887,942

[45] Date of Patent: Dec. 19, 1989

[54] PRESSURE EXCHANGER FOR LIQUIDS

[76] Inventor: Leif J. Hauge, Østre Hallsetvangen 3a, N-7027 Trondheim, Norway

[21] Appl. No.: 246,658

[22] PCT Filed: Dec. 30, 1987

[86] PCT No.: PCT/NO87/00086

§ 371 Date: Sep. 2, 1988

§ 102(e) Date: Sep. 2, 1988

[87] PCT Pub. No.: WO88/05133

PCT Pub. Date: Jul. 14, 1988

[30] Foreign Application Priority Data

Jan. 5, 1987 [NO] Norway ..... 870016

[51] Int. Cl.[4] ..... F04F 11/00

[52] U.S. Cl. ..... 417/64; 60/39.45; 123/559.2

[58] Field of Search ..... 417/64; 60/39.45 R, 60/39.45 A; 123/559.2

[56] References Cited

U.S. PATENT DOCUMENTS

| | | | |
|---|---|---|---|
| 2,675,173 | 4/1954 | Jendrassik | 417/64 |
| 3,101,168 | 8/1963 | Berchtold | 417/64 |
| 3,145,909 | 8/1964 | Gardiner | 417/64 |
| 3,234,736 | 2/1966 | Spalding | 417/64 X |
| 3,431,747 | 3/1969 | Hashemi et al. | 417/64 X |
| 4,209,986 | 10/1964 | Kentfield | 417/64 |
| 4,269,570 | 5/1981 | Rao | 417/64 |
| 4,352,638 | 10/1982 | Vallance | 417/64 |
| 4,360,316 | 11/1982 | Rahnke | 417/64 |
| 4,529,360 | 7/1985 | Kirchhofer et al. | 417/64 |

FOREIGN PATENT DOCUMENTS

| | | | |
|---|---|---|---|
| 0840408 | 7/1960 | United Kingdom | 417/64 |

*Primary Examiner*—Carlton R. Croyle
*Assistant Examiner*—Eugene L. Szczecina, Jr.
*Attorney, Agent, or Firm*—Ladas & Parry

[57] ABSTRACT

A pressure exchanger for transfer of pressure energy from a liquid flow of one liquid system to a liquid flow of another liquid system includes a housing (1) with inlet and outlet ducts forming pairs of ducts for each liquid flow. A cylindrical rotor (8) is rotably arranged in the housing (1), the rotor having a number of axial bores adapted to sequential connection with the passages and thus alternately carry liquid of high pressure of the respective systems. According to the invention the duct openings facing the rotor (8) are found approximately as a segment with a control angle of 180° and a partition wall is formed between these openings. These large openings permit fast liquid flows which fluctuate only to a slight extent.

7 Claims, 5 Drawing Sheets

PRESSURE EXCHANGER FOR LIQUIDS

The invention relates to pressure exchangers for transfer of pressure energy from a liquid flow of one liquid system to a liquid flow of another liquid system, comprising a housing with an inlet- and outlet duct for each liquid flow, and a cylindrical rotor arranged in the housing and adapted to rotation about its longitudinal axis, and provided with a number of passages or bores extending parallel to the longitudinal axis and having an opening at each end, the inlet- and outlet ducts of the liquid systems forming pairs of ducts provided near the respective end faces of the rotor, and the bores of the rotor being adapted to such connection with the inlet- and outlet ducts of the housing that they alternately carry liquid under high pressure and liquid under low pressure of the respective systems during rotation of the rotor.

From U.S.-PS No. 3 431 747 it is known a pressure exchanger of the above-mentioned type, where a ball has been introduced in each bore for separation of the liquids of the two systems. The ball movement is limited due to the arrangement of a seat or stop in each end of each bore, against which the ball can bear. The seats cause a reduction of the cross-section of the bores, and the balls, the bores as well as the seats are exposed to mechanical wear, which leads to leakage. Further, due to the small clearance between the balls and the walls of the respective bores, a large force has to be exerted against the balls in order to move these at high liquid velocities, which results in an energy loss. When the flows of liquid suddenly stops, caused by the balls shock-like hitting their seats, cavitation may occur, which may be detrimental to adjacent parts. The arrangement of a ball and two valve seats with sealing rings, springs etc. for each bore implies that the device becomes complicated and costly. Further, the above-mentioned wear may necessitate time consuming and costly change of component parts of the pressure exchanger. Due to the arrangement of inlet- and outlet ducts which discharge resp. receive liquid from only one bore at the time, the flow will be intermittent.

The object of the invention is to provide a device which to a lesser degree is burdened with the above-mentioned drawbacks.

The characteristic features of the device according to the invention will be evident from the claims.

The invention will be described in detail in the following description with reference to the accompanying drawing, which shows embodiments of a pressure exchanger according to the invention.

FIGS. 6*a* to 6*f* are sectional views depicting the mode of operation of the pressure exchanger.

FIGS. 7*a* and 7*b* are velocity diagrams depicting the mode of operation of the pressure exchanger.

Figure 8:
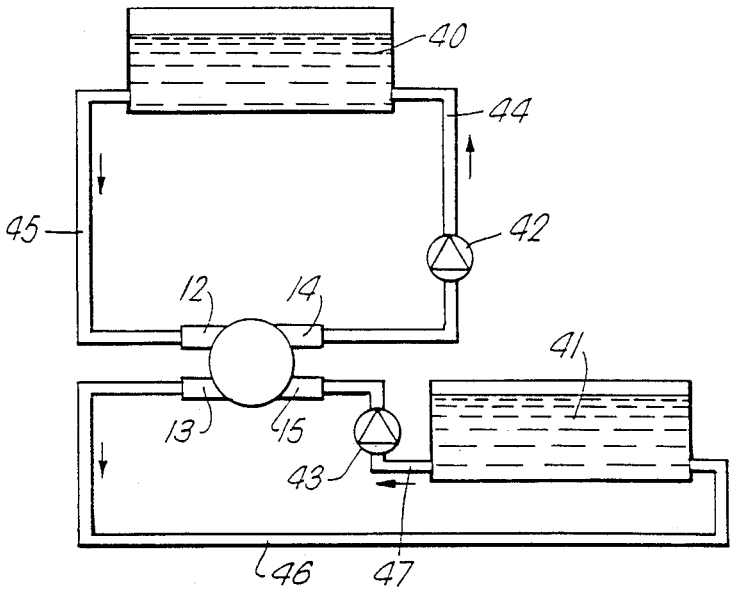

FIG. 8 is a schematic view of a device according to the invention, whereby the device is connected with two liquid reservoirs.

Figure 9A:
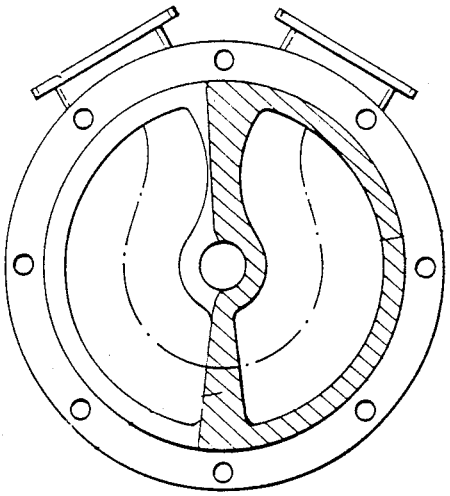
Figure 9B:
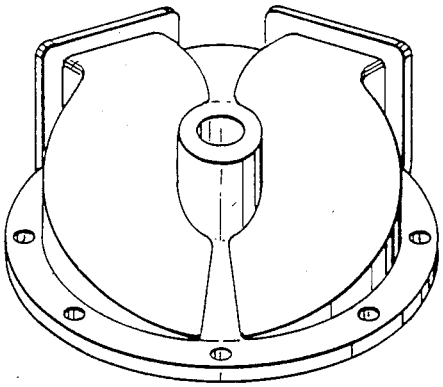
Figure 9C:
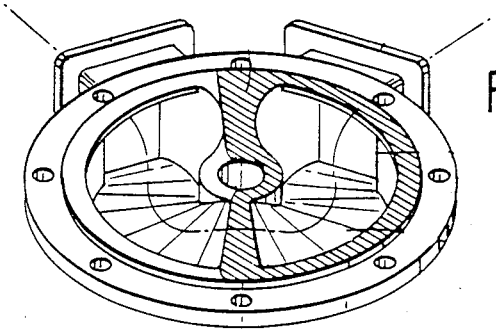

FIGS. 9*a* to 9*c* are views of another embodiment of an end piece.

Figure 1:
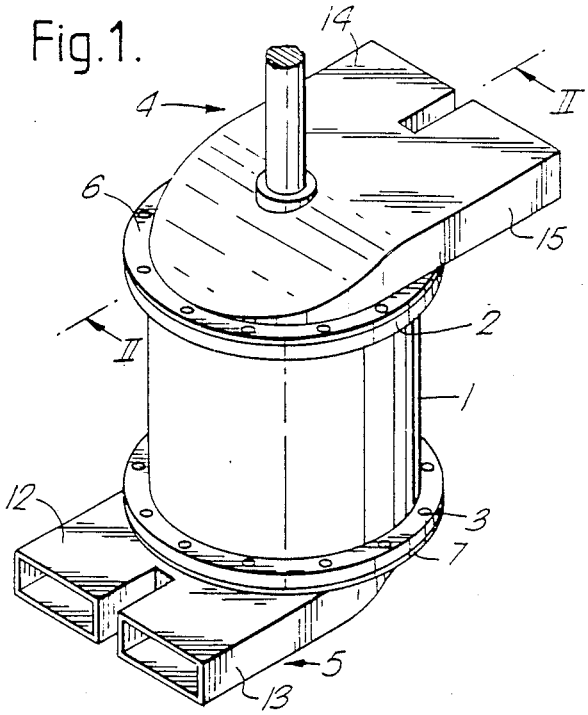
FIG. 1 is a schematic perspective view of a pressure exchanger according to the invention.

As is evident from FIG. 1, the pressure exchanger according to the invention comprises a tubular, mainly cylindrical housing 1, which at each end has a circular flange 2, 3 with a number of through-going holes.

Two substantially identical end pieces 4, 5, both being provided with a circular flange 6, 7 with a diameter and through-going holes corresponding to the flanges of the housing, are sealingly fastened to respective end portions of the housing 1, the flanges 2, 3 of the housing 1 being fastened to the flanges 6, 7 of the respective end pieces 4, 5 by means of not shown bolts which are introduced into the holes, and nuts. In order to obtain a tight connection a sealing ring may be provided between the flanges.

A cylindrical rotor 8 is arranged in the tubular housing 1, the outer diameter of the rotor being adapted to the inner diameter of the housing 1, in such a way that the rotor 8 easily can be rotated in the housing 1. The end surfaces of the rotor extend normal to its longitudinal axis, and its length corresponds approximately to the length of the housing 1. The rotor 8 has a number of axially through-going passages 9. As shown these can have a circular cross-section, the longitudinal axis of which are equally spaced and extend along two cylinder surfaces extending co-axially in relation to the rotor. The diameter of and the spaces between the bores along one of the cylinder surfaces may, however, be different from the diameter of and the intermediate spaces between the bores along the other cylindrical surface. Further, bores may be arranged along only one or more than two cylinder surfaces.

In each of the end pieces 4, 5 it is formed two passages 12, 13 resp. 14, 15 extending close to each other, and having a common wall or partition wall 16 resp. 17, which extends from the inner end facing the housing 1 and the rotor 8, and along at least a part of the length of the ducts. As is evident from FIGS. 4 and 5, the inner openings 18, 19 resp. 20, 21 of each pair of ducts are approximately semi-circular, where the circle diameter may be somewhat smaller than the diameter of the rotor 8, whreby it is formed a shoulder or gliding surface for the rotor which substantially prevents movement of the rotor 8 in the longitudinal direction of the housing 1, while rotation is permitted and whereby a better sealing between the rotor and the housing is obtained. The partition wall between the openings 18, 19 resp. 20, 21 extends towards the respective end surface of the rotor 8, in such a way that this during rotation sealingly may bear against and slide on the end edge of the partition wall. The partition wall and the sliding surface may further comprise a sealing device, which provides a sealing between the rotor and the partition wall resp. the end pieces. The thickness of the partition wall may be constant or vary along a radial line from the centre of the semi-circular, inner openings, as shown in FIG. 9, the thickness being somewhat larger than the transverse dimension of the bores located at the corresponding distance from the longitudinal axis of the rotor. As is evident from FIG. 2, the longitudinal axis of the inner portion 10 of the ducts extends substantially at an angle in relation to the plane of rotation of the rotor 8, while the longitudinal axis of the outer portion 11 of the ducts extends substantially parallel thereto. The longitudinal axis of the outer portion 11 of the ducts may be parallel to each other or be arranged at an angular distance from each other in this plane, as shown in FIG. 9. The outer end portion 11 of the ducts may be provided with flanges or threads (not shown) for connection of the ducts to the pipes of a pipe system.

The sloping wall of the inner duct portion, opposite of the rotor, is substantially S-shaped, in a circular, co-axial section relative to the longitudinal axis of the rotor, whereby the closest and the most remote from the rotor lying wall portions extend approximately parallel to or at a small angle relative to the plane of rotation, while the intermediate portion extends at a larger angle in relation thereto. More specifically, the slope of the wall along this section and relative to the plane of rotation may be approximately a sine-function of the angle, measured in the plane of rotation of the rotor and in the direction of rotation, which is formed between two planes that both comprise the longitudinal axis of the rotor, but where the first plane, or the plane of reference, additionally comprises the portion of the duct opening in question, which during rotation of the rotor is first reached by the bores thereof, and the second plane comprises the wall portion in question.

Figure 2:
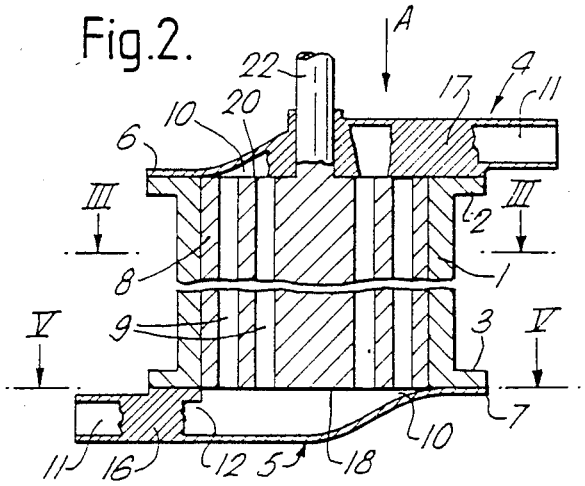
FIG. 2 is a sectional view taken along the line II—II in FIG. 1, whereby portions have been removed.
Figure 3:
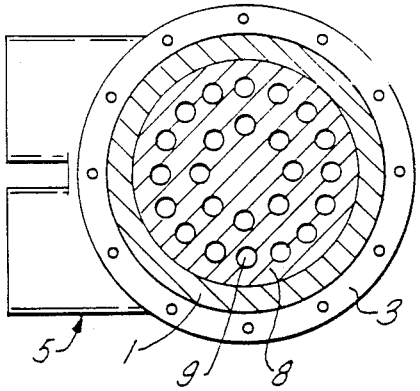
FIG. 3 is a sectional view taken along the line III—III in FIG. 2.
Figure 4:
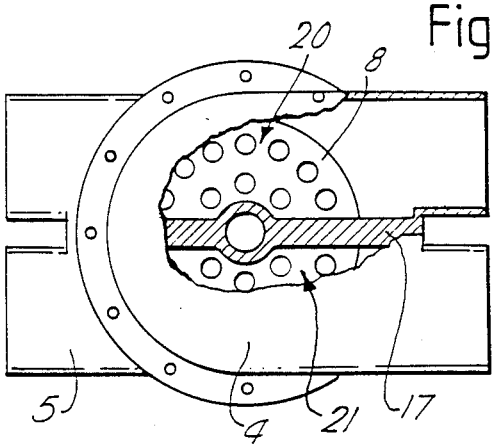
FIG. 4 is a view in the direction of the arrow A in FIG. 2, whereby portions have been removed.
Figure 5:
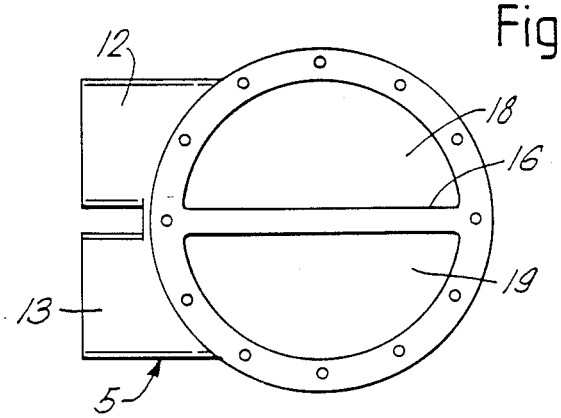
FIG. 5 is a view showing the end piece openings facing the rotor.

As shown in the drawing, the two end pieces 4, 5 are mutually angularly displaced 180° in the plane of rotation in such a way that the outer openings of the pairs of ducts are facing in opposite directions. As shown in FIGS. 2 and 4, a shaft 22 which sealingly extends through the partition wall 17 of the end piece 4, and which is connected to an electric motor (not shown) or the like, may be fixedly connected to the rotor for rotation thereof.

Figure 6A:
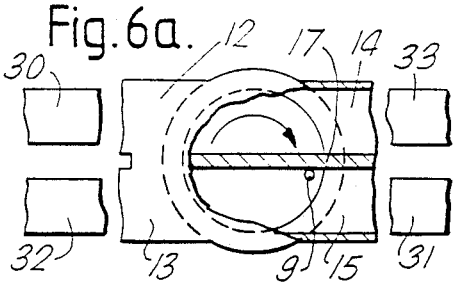
Figure 6D:
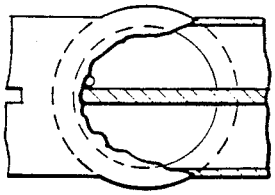
Figure 6B:
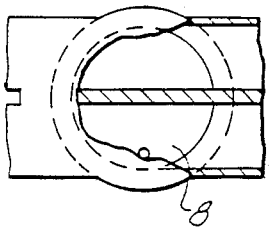

The mode of operation of the pressure exchanger according to the invention will in the following description be described in detail with references to FIGS. 6 and 7.

For the recovery of the pressure energy of a first liquid, for instance waste liquid in a process, whereby this liquid shall be used for raising the pressure of another liquid which is used in connection with another process, a supply tube 30 which carries the waste liquid is connected to the duct 12 of the pressure exchanger, and a tube 31 for supply of the other liquid is connected to the duct 15. Further, a discharge tube 32 for the waste liquid is connected to the duct 13, and a discharge tube 33 for the other liquid is connected to the duct 14. In the following liquid pressure will be designated p, and for designation of the liquid pressure in the respective ducts this designation letter will be given a suffix corresponding to the designation number of the duct.

By way of introduction it is assumed that p12>p14>p15>p13. For the description of the mode of operation the liquid flow for a particular rotor bore will be described, assuming that the rotor is driven by a motor. FIGS. 6*a* to 6*f* show successive positions of this bore 9 during rotation of the rotor 8. FIG. 6*a* depicts the rotor in a position where the bore 9 in question has just been brought to communication with the duct 13 and 15. As p15>p13 the displacement of the waste liquid which is contained in the bore is thereby started. When the rotor has passed the position shown in FIG. 6*b* and reached the position shown in FIG. 6*c*, in which the bore is being closed by the partition walls 16, 17, approximately all waste liquid has been displaced from the bore, and this has been filled with the other liquid. As the rotor reaches the position shown in FIG. 6*d*, whereby the bore is opened for communication with the ducts 12 and 14, the pressure of the liquid is immediately raised to a level between the pressures p12 and p14, and the high pressure p12 of the waste liquid will cause initiation of a liquid flow into the duct 12 and displace the other liquid, so that this flows out of the duct 14. The pressure of the liquid in the duct 14 may hereby be controlled by means of a control valve (not shown) or a similar device.

Figure 6E:
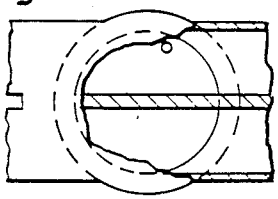
Figure 6C:
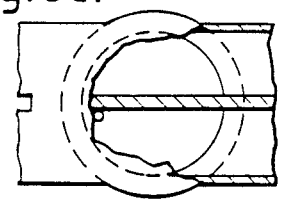
Figure 6F:
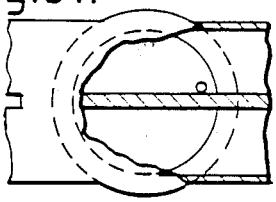
Figure 7:
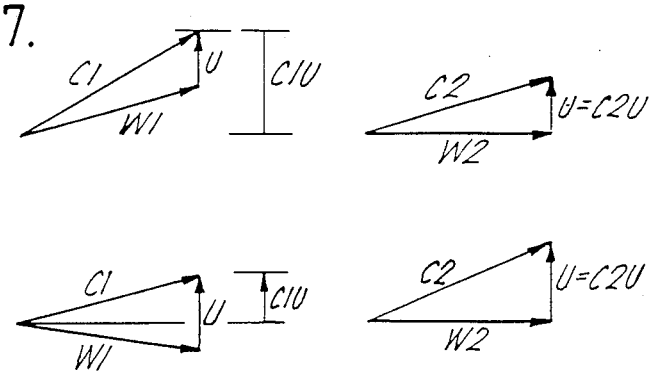

When the rotor has passed the position shown in FIG. 6*e* and reached the position shown in FIG. 6*f*, where the bore again is being closed by the partition walls 16, 17, approximately all the other liquid in the bore has been displaced by the waste liquid. When the rotor during continued rotation again reaches the position shown in FIG. 6*a*, where the duct is opened for communication with the duct 13 and 15, the above described cycle is started over again.

FIGS. 7*a* and *b* show velocity diagrams for the inlet and the outlet of a particular bore of the rotor, whereby C1 and C2 designate the absolute velocity of the liquid, W1, W2 designate the liquid velocity relative to the duct, and U designates the velocity of the bore relative to the housing. C1U and C2U designate the component of C1 resp. C2, which extend in the direction of U. Although it is mentioned above that the rotor is driven by a motor, it is evident, however, that the sloping, inner portion 10 of the liquid inlet ducts 12 and 15 in combination with the axially extending bores 9 will cause an exertion of a moment seaking to rotate the rotor, this moment being proportional to (C1U–C2U). Thus, a motor for rotation of the rotor is in this case superfluous. If the difference between the liquid pressures is sufficiently large, it will nor be necessary to provide liquid pumps to overcome the flow resistance of the tubes, the pressure differential providing the desired liquid flow.

If the pressure of the waste liquid is equal to the pressure of the other liquid, i.e. p12=p14 and p13=p15, and the displacement of liquid in the bores cannot be obtained by means of pressure differentials as mentioned above, such flow must be provided in another way. One possibility is to provide circulating- or liquid pumps 42, 43 as shown in FIG. 8, in order to overcome the flow resistance of the associated tube system. FIG. 8 illustrates schematically the case in which the pressure exchanger is used for supply of for instance hot water to a reservoir 40 positioned at a high level, from a reservoir 41 positioned at a low level, where the cold water flowing from the high reservoir is used for raising the pressure of the water which flows from the low reservior. It is hereby provided a pump 42 in the tube 44 which connects the duct 14 to the high reservoir 40, and a pump 43 in the tube 47 which connects the low reservoir with the duct 15. Alternatively, however, the pressure exchanger may operate as a pump, due to the sloping, inner portion of the ducts 12 resp. 15, whereby the necessary moment for rotation of the rotor is approximately proportional to the difference (C2U-C1U), as shown in FIG. 7*b*. As is evident from this Figure, this difference is positive at a suitable velocity U of the bore in question. Thus, the liquid pumps 42, 43 may be superfluous if the rotor is operated by means of a motor.

Due to the simultaneous communication of a larger number of bores 9 with the ducts 12, 13 resp. 14, 15, liquid will always flow in these, and as the bore opening area which during rotation of the rotor is being covered and closed by the one half portion of the partition walls, corresponds to the duct opening area which simultaneously is being opened by the other, diametrically opposite half of the partition wall, the liquid flow in the bores will pulsate only to a small extent. Due to the above-mentioned design the pressure exchanger according to the invention will permit very rapid liquid flows and have a greater efficiency than the known pressure exchangers. Especially at high liquid velocities it is important that the liquid flow is steady. Due to the above-mentioned shape of the duct inner portion wall which is opposite to the rotor, it is possible to obtain that the component of the velocity in the longitudinal direction of the rotor of the liquid flowing in resp. out is small adjacent to the bores which are about to be moved away from resp. under the partition wall, i.e. opened resp. closed, while this component of the liquid flow velocity is large at the intermediate bores, and that the transition from small to large velocity is smooth. This shape of the wall brings about smooth acceleration and deceleration of the liquid flow in the bores, which takes place with great efficiency, without choking, and which contributes to further reduction of the pulses of the liquid flow.

I claim:

1. Pressure exchanger for transfer of pressure energy from a liquid flow of one liquid system to a liquid flow of another liquid system, comprising a housing (1) with an inlet- and an outlet duct (12, 13 resp. 14, 15) for each liquid flow, and a cylindrical rotor (8) arranged in the housing (1) and adapted to rotation about its longitudinal axis, and provided with a number of passages or bores (9) extending parallel to the longitudinal axis and having an opening at each end, the inlet- and outlet ducts of the liquid systems forming pairs of ducts provided on respective sides of the rotor (8), and the bores of the rotor (8) being adapted to such connection with the inlet- and outlet ducts of the housing that they alternately carry liquid under high pressure and liquid under low pressure of the respective systems during rotation of the rotor, characterized in that the inner openings of the ducts, i.e. the openings being close to the rotor, are formed approximately as a segment of a circle with a central angle of 180°, and that a partition wall is formed between these openings of each pair of ducts.

2. Pressure exchanger according to claim 1, characterized in that the longitudinal axis of the outer end portion of the ducts, i.e. the end portions being most remote relative to the rotor, extend approximately parallel relative to the plane of rotation of the rotor, and that the longitudinal axis of the inner end portions of the ducts is inclined relative to the plane of rotation.

3. Pressure exchanger according to claim 1, characterized in that during rotation of the rotor the ducts are adapted to provide a liquid flow, the axial velocity component of which varies along circular sections being concentric relative to the longitudinal axis of the rotor, in such a way that the portions of the flow being adjacent to those rotor bores that are being connected to the respective ducts, resp. whose connection to the respective ducts are being cut off, are flowing slower than the intermediate flow portion.

4. Pressure exchanger according to claim 3, characterized in that the inclined wall of the inner end portion of a duct, opposite the rotor, is wave-shaped in a cylindrical, co-axial section relative to the longitudinal axis of the rotor, in such a way that the angle between the plane of rotation and the plane of the wall area in question is approximately the sine-function of the angle, measured in the plane of rotation of the rotor and in the direction of rotation, which is formed between two planes that both comprise the longitudinal axis of the rotor, but where the first plane, or the plane of reference, additionally comprises the portion of the duct opening in question, which during rotation of the rotor is first reached by the bores thereof, and the second plane comprises the wall portion in question.

5. Pressure exchanger according to claim 1, characterized in that the longitudinal axis of the outer portions of the ducts of one and the same pair of ducts have a small angle of displacement relative to each other, and that the pairs of ducts are angularily displaced 180° relative to each other, measured in the plane of rotation of the rotor.

6. Pressure exchanger according to claim 1, characterized in that the bore openings of the rotor and the inner openings of the duct are mutually adapted in such a way that the total area of the bore opening surface which is open to a duct in question, is substantially constant during rotation of the rotor.

7. Pressure exchanger according to claim 1, characterized in that the rotor is adapted to being rotated by means of a motor.

* * * * *